US006324977B1

(12) United States Patent
Hadden

(10) Patent No.: US 6,324,977 B1
(45) Date of Patent: Dec. 4, 2001

(54) STAMP ASSEMBLY WITH EMBOSSING MEMBER

(75) Inventor: David M. Hadden, Los Altos, CA (US)

(73) Assignee: Arlo, Inc., Los Altos, CA (US)

( * ) Notice: Subject to any disclaimer, the term of this patent is extended or adjusted under 35 U.S.C. 154(b) by 0 days.

(21) Appl. No.: 09/560,429

(22) Filed: Apr. 28, 2000

(51) Int. Cl.[7] ..... B41K 1/56

(52) U.S. Cl. ..... 101/405; 101/406; 101/327; 101/109

(58) Field of Search ..... 101/405, 406, 101/327, 333, 103, 108, 109, 368; 40/328

(56) References Cited

U.S. PATENT DOCUMENTS

| | | | | |
|---|---|---|---|---|
| 2,970,539 | * | 2/1961 | Griffin | 101/368 |
| 3,973,495 | * | 8/1976 | Rowe | 101/405 |
| 4,187,772 | * | 2/1980 | Hollenbeck | 101/379 |
| 4,854,235 | * | 8/1989 | Lyon | 101/389.1 |
| 4,896,604 | * | 1/1990 | Urbanowicz | 101/379 |
| 5,191,837 | * | 3/1993 | Bolton | 101/333 |
| 5,313,885 | * | 5/1994 | Winston | 101/405 |
| 5,642,667 | * | 7/1997 | Sastre | 101/405 |
| 5,655,451 | * | 8/1997 | Wasylczuk et al. | 101/368 |
| 6,095,046 | * | 8/2000 | Lookholder et al. | 101/405 |

OTHER PUBLICATIONS

Sax, Irving N, 1987, Hawley's Condensed Chemical Dictionary, Eleventh Edition, p. 1018.*

Sax, Irving N, 1987, Hawley's Condensed Chemical Dictionary, Eleventh Edition, pp. 453, 454, 925, 933, 943, 1039, 1040, and 1101.*

The Cling Thing, Interchangeable Mounting System, by SonLight Impressions. Two pages of package literature and one page from website.

FAQS for GridBlocs, 2 pages, Sep. 1999 or earlier, Inkslingers, 1721A Rogers Avenue, San Jose CA 95112.

* cited by examiner

*Primary Examiner*—John S. Hilten
*Assistant Examiner*—Ken D. Williams
(74) *Attorney, Agent, or Firm*—Flehr Hohbach Test Albritton & Herbert LLP

(57) ABSTRACT

A stamp assembly for use with an ink to create an image having an area on a surface of a workpiece. The stamp assembly comprises a handle member having a surface with an area at least approximating the area of the image. A flexible sheet-like embossing member is provided and has opposite first and second sides. The first side has a first side surface and the second side has an embossed portion with a substantially planar raised surface corresponding to the image. The first side of the embossing member is removably secured by interfacial tack to the surface of the handle member. The embossed portion is adapted to receive ink on the raised surface and the raised surface is adapted to thereafter engage the surface of the workpiece to form the image on the workpiece.

36 Claims, 3 Drawing Sheets

STAMP ASSEMBLY WITH EMBOSSING MEMBER

This invention relates to stamps for forming images on a surface of a workpiece and more particularly to stamps for applying ink to the surface of the workpiece to create the image.

Stamps for forming an image from ink on a surface of a workpiece have heretofore been provided. Such stamps typically include a handle or stamp mount made from a substantially rigid material and an embossing member made from a suitable flexible material such as rubber secured to the stamp mount. The stamp mount is usually formed with a substantially planar bottom surface to which the embossing member is secured. A layer of an elastomeric material such as foamed rubber is sometimes disposed between the bottom surface of the stamp mount and the embossing member for facilitating the formation of the image on an irregular surface. Unfortunately, the stamp mount and the embossing member are usually secured together, directly or indirectly, in a permanent manner. An adhesive is often used in this regard. This permanent bond can result in tears in the embossing member when one attempts to remove the embossing member from the stamp mount. As a result of the foregoing, a separate stamp mount with a dedicated embossing member thereon is typically required for forming each image.

An embossing member for removable attachment to a mount has been provided. See in this regard the Glintzes embossing members, made by Inkslingers of San Jose, Calif., which are removably mountable to a mount by a fluid which secures the pieces together by means of surface tension. Such embossing members, however, require a few drops of water or another fluid for attachment and are thereafter slidable over the surface of the mount so as to hinder the retention of the embossing member in a desired location on the mount. Another removable embossing member is provided with a mounting tab which extends perpendicularly from the rear surface of the embossing member and seats within a cooperatively sized recess provided in the stamp mount. The awkward shape of such embossing members hinders their storage and limits the shape of the mount onto which they can be attached.

Some of the stamp assemblies have stamp mounts and embossing members made from an optically transparent material to permit viewing of the surface of the workpiece through the stamp mount.

It is in general an object of the invention to provide anew and improved stamp assembly having an embossing member that is removably secured to the stamp mount of the stamp assembly.

Another object of the invention is to provide a stamp assembly of the above character in which the embossing member can be removably secured to the stamp mount by means of interfacial tack.

Another object of the invention is to provide a stamp assembly of the above character which can be at least partially transparent so as to facilitate placement of the image on the surface of the workpiece.

Another object of the invention is to provide a stamp assembly of the above character in which the stamp mount has a surface for receiving the embossing member which is arcuate in conformation.

Another object of the invention is to provide a stamp assembly of the above character in a which the surface of the stamp mount is concave.

Another object of the invention is to provide a stamp assembly of the above character in which the surface of the stamp mount is convex.

Another object of the invention is to provide a stamp assembly of the above character in which the stamp mount has a bendable wall for receiving the embossing member.

Another object of the invention is to provide a stamp assembly of the above character in which the stamp mount can be a container for storing the removable embossing member.

These and other objects are achieved in accordance with the invention by providing a stamp assembly for use with an ink to create an image having an area on a surface of a workpiece. The stamp assembly comprises a handle member having a surface with an area at least approximating the area of the image. A flexible sheet-like embossing member is provided and has opposite first and second sides. The first side has a first side surface and the second side has an embossed portion with a substantially planar raised surface corresponding to the image. The first side of the embossing member is removably secured to the surface of the handle member by means of interfacial tack. The embossed portion is adapted to receive ink onthe raised surface and the raised surface is adapted to thereafter engage the surface of the workpiece to form the image on the workpiece.

Figure 1:
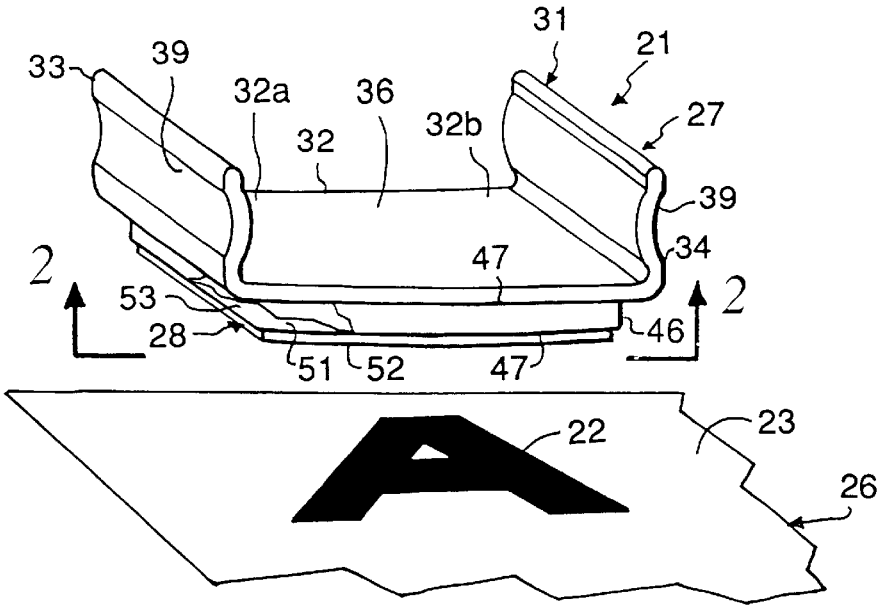
FIG. 1 is an isometric view, partially cut away, of a stamp assembly with a removable embossing member of the present invention.

In general, stamp assembly 21 of the present invention is for use with a conventional ink pad (not shown) for forming an image 22 on a surface 23 of a work piece such as a sheet of paper 26 (see FIG. 1). The stamp assembly includes a handle member or handle 27 and an embossing member 28. The image 22, shown in FIG. 1 after having been formed from ink on surface 23 of the sheet of paper 26, has an area defined by the surface area of the image.

Figure 2:
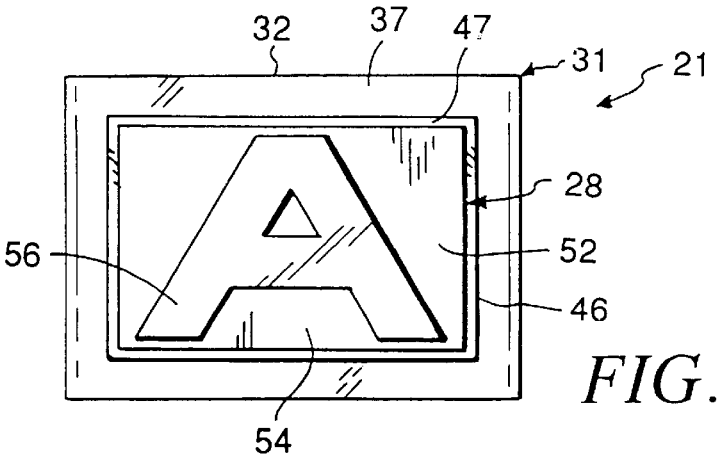
FIG. 2 is a bottom plan view of the stamp assembly of FIG. 1 taken along the line 2—2 of FIG. 1.

Handle or stamp mount 27 is formed from a substantially rigid body 31 having a U-shape cross section and being made from any suitable material such as plastic. Handle body 31 shown in FIGS. 1 and 2 is extruded from a suitable plastic of the type discussed below and has a substantially planar bottom wall 32 and at least one finger-grippable wall in the form of first and second side walls or grips 33 and 34. The bottom wall 32 has a first or left side 32*a* and a second or right side 32*b* and a top substantially planar surface 36 and a bottom substantially planar, smooth surface 37. The first or left grip 33 and the second or right grip 34 extend upwardly from top surface 36 and, as shown, are formed integral with respective left and right sides 32*a* and 32*b* of the bottom wall 32 of extruded body 31. First and second grips 33 and 34 bow inwardly toward each other to form respective recesses 39 therein that extend along the length of the grips for facilitating holding of the grips 33 and 34 between at least two fingers of a human hand, such as the thumb and the opposing fingers of the hand.

Although stamp assembly 21 can be scaled to any suitable size, bottom wall 32 of the handle body 31 has an area at least approximating the area of the image. Body 31 is shown as having a width between its left and right sides 32*a* and 32*b* ranging from 0.25 to eight inches and preferably ranging from 1.5 to 2.5 inches and a length extending between its front and back ranging from 0.25 to eight inches and preferably ranging from 1.5 to 2.5 inches. Left and right grips 33 and 34 can each have a height ranging from 0.25 to 1.25 inch and preferably approximately 0.75 inch. The walls 32–34 of body 31 each have a thickness ranging from 0.035 to 0.250 inch and preferably approximately 0.090 inch so as to be substantially rigid.

Stamp mount 27 can optionally include a layer of material in the form of a cushion 46 having opposite top and bottom parallel surfaces 47. Cushion 46 is secured to bottom surface 37 of body 31 and is made from any suitable material such as a soft rubbery material or elastomer. The cushion 46 has a shape in plan which preferably corresponds to the shape of bottom wall 32 and, as shown in FIG. 2, is rectangular in plan. Cushion 46 has a thickness ranging from 0.050 to 0.20 inch and preferably approximately 0.125 inch. The surface area of the cushion 46 is less than the surface area of bottom surface 37 and preferably ranges from 50% to 95% of the area of bottom surface 37. In alternate embodiments, the optional cushion 46 or other such layer of material can have a shape in plan that closely matches the shape and size of image 22. For example, cushion 46 could have the shape of the letter A to match the A shape of image 22.

Top surface 47 of cushion 46 is secured to bottom surface 37 of bottom wall 32 by any suitable means such as an adhesive (not shown). Alternatively, cushion 46 can be removably secured to the bottom wall 32 by any suitable means such as interfacial tack. In general, tack is the ability of a material of an adhered, such as cushion 46, to adhere instantaneously to a surface of a substrate, such as handle body 31, when the adhered and the substrate are brought into contact under light pressure. As used herein, "interfacial tack" does not include an adherence that is accomplished with separate pressure-sensitive or other adhesives or with the use of fluids, such as water, to create a bond by means of surface tension. The adhering force is such that only a small amount of force is required to separate the adhered and the substrate. Such a bonding process involves thermodynamic and kinetic parameters and other factors such as mechanical interlocking between the surfaces being brought into contact.

In order to provide the weak adhesion, that is interfacial tack, between top surface 47 of the cushion 46 and bottom surface 37 of the bottom wall 32, the material of cushion 46 should have the ability to wet the bottom surface 37 of stamp mount 27. In general, wetting refers to the ability of a material, such as the material of cushion 46, to conform intimately to a surface, such as bottom surface 37. Such wetting ability of cushion 46 can be attained by the use of increased molecular mobility on top surface 47 of the cushion. This increased molecular mobility can be achieved by providing surface 47 with a low degree of crosslinking or a low hardness, by use of polymer blends or gels to form the surface 47 and/or by ensuring that the surface energy of the cushion 46 is lower than the surface energy of handle body 31. Such wetting ability of the cushion 46 can also be achieved by ensuring that top surface, 47 of the cushion 46 is smooth to allow optimum wetting of bottom surface 37 or by temporarily warming top surface 47 to make the surface 47 tacky and then attaching the cushion 46 to the handle body 31. After the cushion 46 cools to room temperature, the cushion will maintain a temporary bond with the handle body.

Handle body 31 is preferably made from a material that has the ability to be wetted by cushion 46. In addition, and as discussed above, the bond formed between cushion 46 and handle body 31 should be such that only a small amount of force is required to separate the materials. The foregoing can be accomplished by one or more of several approaches. In one approach, handle body 31 is made from a material that has a higher surface energy than the material of cushion 46 This can be achieved either by using high-energy materials such as nylons, polyethylenes, polypropylenes (PP), polyesters (P), acrylonitrile butadiene styrene (ABS), high impact polystyrene (HIPS), polyvinyl chloride (PVC), polymethylmethacrylate (PMMA), polyethylene terephthalate (PET) polyethylene terephthalate (PETG), polystyrene, polycarbonate and engineered polymers such as polysulfone, polyethersulfone and polyetherimide or by treating surface 37 of the handle body 31 by chemical etching, corona treatment, surface grafting of chemicals or other similar techniques. In a second approach, bottom surface 37 is made smooth to optimize wetting of such surface by the material of cushion 46. In a third approach, bottom surface 37 can be temporarily warmed prior to attachment of the cushion 36 46 to handle body 31 Such warming makes surface 37 tacky at the time of contact, which tackiness declines after cooling to room temperature so as to allow separation of surfaces 37 and 47 without the application of much force.

In a fourth approach, the molecular mobility on substrate surface 37 is increased so that wetting between surface 37 and cushion 36 can readily occur. Such an increase in molecular mobility can be achieved by forming handle body 31 with suitable materials such as polymer blends, plasticizing additives and lower molecular weight materials. In a fifth approach, a two-layer substrate can be used. For example, handle body 31 can be formed with top and bottom layers, the material of the top layer being harder than the material of the bottom layer for maintaining dimensional and structural integrity in the handle body 31. The bottom layer contacts cushion 46 and can have its properties optimized, by one or more the foregoing approaches, to allow optimum wetting with the cushion. The top and bottom layers of such a handle body 31 would be bonded in such a way that the strength of that bond would be far greater than that of the bond formed between the handle body and the cushion 46.

Bottom surface 37 of the handle body 31 should have a surface energy of greater than 20 dynes/cm and preferably greater than 30 dyne/cm. Surface 37 should additionally have a surface hardness greater than 10 Shore A and be relatively smooth to allow optimum wetting by the cushion 46. Suitable plastics for use in forming at least the bottom surface 37 of handle body 31, and preferably all of handle body 31, include rigid plastics such as nylons, polyethylenes, polypropylenes, polyesters, ABS, HIPS, PVC, PMMA, PET, PETG, polystyrene, polycarbonate and engineered polymers such as polysulfone, polyethersulfone and polyetherimide. Any of the above materials can be formed in a foamed state and be suitable for use in forming the bottom portion of handle body 31. The bottom surface 37 of handle body 31, or alternatively all of handle body 31, can also be made from nonplastic materials such as metal, ceramic, glass and wood. A particularly preferred metal is aluminum.

It is preferable that at least the upper surface 47 of cushion 46 be made from a material having a surface energy of less than 50 dynes/cm, preferably less than 40 dynes/cm and more preferably less than 30 dynes/cm. Such surface should also have a softness of less than 60 Shore A and preferably less than 50 Shore A, and be relatively smooth to allow optimum wetting of bottom surface 37 of the handle body 31. It should be appreciated that in certain combinations of materials for substrate surface 37 and cushion surface 47, cushion 46 can be made from a very soft material or gel and may have a surface energy higher than the surface energy of substrate surface 37.

Suitable elastomers for use in forming at least the upper surface 47 of cushion 46, and preferably all of the cushion 46, include (i) thermoplastic elastomers, (ii) elastomers that are crosslinkable by means of sulfur, peroxide, irradiation, room temperature vulcanization (RTV) or other similar techniques and (iii) noncrosslinked rubbery materials. Particularly preferred elastomers include natural rubber, polyisoprene, styrene butadiene rubbers (SBR), styrene-ethylenebutylene-styrene (SEBS) rubbers, polybutadiene, polyisobutylene, nitrile rubber, butyl rubber, polychloroprene rubber (Neoprenes), chlorinated polyethylene rubber, silicone rubber such as room temperature vulcanizing (RTV) silicone, fluorocarbon rubber, polyurethane elastomers, ethylenepropylene rubbers (EPM, EPDM), olefenic thermoplastic elastomers (TPO), thermoplastic copolyesters and thermoplastic copolyamides. Modified elastomers that are suitable for use in forming at least upper surface 47 include elastomers, such as any of those discussed above, that have been modified through the use of additives such as plasticizers to increase their tack and flow properties. Typical examples of such modified elastomers include soft elastomers such as gels. Some particularly preferred gels are made of silicone, styrene-butadiene-styrene (SBS) or SEBS polymers.

Embossing member 28 has opposite first and second sides in the form of first or top side 51 and second or bottom side 52 and is preferably a flexible member. The top side 51 has a substantially planar, smooth top surface 53. The bottom side 52 is provided with a planar base surface 54 and an embossed portion comprising a substantially planar raised surface 56 extending substantially parallel to the base surface 54. The raised surface 56 has a size and shape corresponding to image 22 and is spaced above the base surface 54 a suitable distance such that when ink from the ink pad is received by the raised surface 56, the ink can be applied to surface 23 of sheet of paper 26 to form the image 22 on the surface 23. Embossing member 28 can be made from any suitable material, such as any of the materials discussed above with respect to cushion 46.

Top surface 53 of embossing member 28 is removably secured to bottom surface 47 of cushion 46 by any suitable means such as interfacial tack. When the embossing member 28 is secured to the cushion 46 by means of interfacial tack, top surface 53 should be a smooth surface unless the material of embossing member 28 that forms surface 53 is a gel. The material of embossing member 28 forming raised surface 56 must be sufficiently rigid so that the raised surface 56 can retain the image 22 during the stamping operation. It should be appreciated that embossing member 28 can be of a composite construction. For example, the material forming top surface 53 can be a gel and the material forming raised surface 56 can be a nongel or a gel with greater rigidity than the gel material forming top surface 53.

Alternatively, the embossing member 28 can be permanently secured to the bottom surface 47 of cushion 46 by any suitable means such as an adhesive (not shown). The embossing member 28 preferably has a surface area in plan which closely approximates the surface area of cushion bottom surface 47 and more preferably has a surface area which is slightly less than the surface area of bottom surface 47 (see FIG. 2).

It should be appreciated from the foregoing that cushion 46 can be removably secured, by means of interfacial tack or otherwise, or permanently secured to the bottom surface 37 of body 31 and that embossing member 28 can be removably secured, by means of interfacial tack or otherwise, or permanently secured to the bottom surface 47 of cushion 46. Thus, a stamp assembly 21 having a cushion 46 permanently secured to body 31 and an embossing member 28 permanently secured to cushion 46 and a stamp assembly having a cushion 46 removably secured to body 31 and an embossing member 28 removably secured to cushion 46 are each within the scope of the present invention. In addition, a stamp assembly having a cushion 46 removably secured to body 31 and an embossing member 28 permanently secured to cushion 46 or, alternatively, a stamp assembly having a cushion 46 permanently secured to body 31 and an embossing member 28 removably secured to the cushion 46 are also each within the scope of the present invention. As mentioned above, a stamp assembly without cushion 46 is further contemplated and embossing member 28 thereof can be removably secured or permanently secured to bottom surface 37 of the handle body 31 of such a stamp assembly. Where a cushion 46 is utilized and both the cushion 46 and embossing member 28 are each removably mountable, it is preferable that it be easier to remove the embossing member 28 from the cushion 46 than it is to remove the cushion from body 31 so that removal of the embossing member after use does not undesirably result in the removal of the cushion from stamp mount 27.

Stamp mount 27, embossing member 28 and optional cushion 46 can be any suitable color or tint, and can be opaque, translucent or transparent. Preferably, the stamp mount 27, the embossing member 28 and any cushion 46 are at least partially transparent or semitransparent so that the ink being applied by raised surface 56 to paper surface 23 can be viewed from the top of body 31 through the stamp mount 27, the embossing member 28 and the optional cushion 46.

In operation and use of a stamp assembly 21 having an embossing member 28 removably secured to cushion 46, top surface 53 of the embossing member 28 is placed against bottom surface 47 of cushion 46 to secure the embossing member to stamp mount 27. The user then grasps left and right grips 33 and 34 between his or her thumb and opposing fingers and presses raised surface 56 against the ink pad or other suitable ink source to deposit a layer of ink on the raised surface 56. The user next presses the raised surface 56 against surface 23 of the sheet of paper 26 to form image 22 on the sheet of paper, as shown in FIG. 1.

During the stamping process, the interfacial tack securing cushion 46 to handle body 31 and securing embossing member 28 to the cushion 46 precludes the cushion 46 and the embossing member from coming off of the stamp mount 27 or sliding on bottom surface 37 thereof. The user can view the placement of the ink on paper 26 through the transparent material of stamp mount 27, cushion 46 and embossing member 28. The utilization of spaced-apart left and right side grips or arms 33 and 34 extending from opposite sides 32*a* and 32*b* of the handle body 31 provide stamp mount 27 with an uncluttered central portion to facilitate viewing of the stamped image therethrough.

The elastomeric material of cushion 46 permits stamp assembly 21 to accommodate uneven work surfaces, such as irregularities in surface 23. In this regard, cushion 46 can deform while stamp mount 27 is being pressed against paper 26. Raised surface 56 can thus be pressed into any recesses in surface 23 or contract upwardly to accommodate any protuberances in the paper surface 23.

Cushion 46 further serves the purpose of inhibiting rubber burn, that is unwanted ink from being deposited on surface 23 of the paper 26. As discussed above, and as shown in FIGS. 1 and 2, embossing member 28 has a size and shape in plan which approximates the size and shape of cushion 46. In addition, the cushion 46 has a thickness such that the bottom side 52 of embossing member 28 is spaced a significant distance below bottom surface 37 of handle bottom wall 32. The inclusion of cushion 46 thus inhibits ink from contacting bottom wall 32 during the loading of ink onto raised surface 56. The cushion 46 further inhibits the bottom edges of wall 32 from contacting the sheet of paper 26 during formation of image 22 on the paper. Thus, any ink that may have accumulated on handle bottom wall 32 during ink loading is unlikely to contact the paper 26.

Once image 22 has been so formed on paper 26, stamp assembly 21 can be used for forming further copies of image 22 on suitable workpieces. Additional ink can be supplied to raised surface 56 as needed. After completion of such process, embossing member 28 can be peeled from cushion 46 and another similar embossing member secured to cushion 46 in the manner discussed above with respect to embossing member 28. Cushion 46 can also be easily removed from handle body 31 when needed. No adhesive residue remains on bottom surface 37 after removal of the cushion 46. Stamp mount 27 can thus be utilized with a plurality of embossing members. The surfaces of each of cushion 46 and embossing member 28 utilized for attachment by means of interfacial tack have characteristics that permit them to be cleaned with a solvent, such as water or alcohol, that does not swell the material of such parts. These parts can thus be easily cleaned for reuse without harming the ability of the parts to be later secured to the appropriate surface of stamp assembly 21 by means of interfacial tack. The reusable nature of stamp mount 27 reduces the cost of image formation because only one mount 27 is needed for using many embossing members 28.

A kit (not shown) which includes a package having one or more stamp mounts 27 and a plurality of removable embossing members 28 can be provided. Such embossing members can be alternatively used on either or both of such stamp mounts 27 in the manner discussed above.

Figure 3:
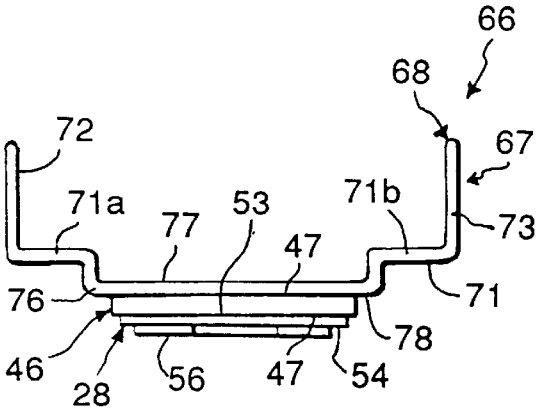
FIG. 3 is a front elevational view of another embodiment of the stamp assembly of the present invention.

Another embodiment of a stamping assembly of the present invention is shown in FIG. 3. Stamping assembly 66 therein has similarities to stamping assembly 21 and like reference numerals have been used to describe like components of stamp assemblies 21 and 66. A handle member or handle 67 is included in stamp assembly 66. The handle or stamp mount 67 is formed from a body 68 that has a U-shaped cross section, as shown FIG. 3, and can be extruded from any suitable substantially rigid material such as plastic. Any of the materials discussed above with respect to stamp mount 27 of stamp assembly 21 are suitable for handle body 68. Substantially rigid handle body 68 has a bottom wall 71 having a first or left side 71 a and a second or right side 71*b*. At least one finger-grippable wall extends upwardly from bottom wall 71. More specifically, a first or left side wall or grip 72 extends upwardly from left side 71*a* and a second or right side wall or grip 73 extends upwardly from right side 71*b*. The grips 72 and 73, substantially identical to each other, are spaced apart from and parallel to each other. Bottom wall 71 and left and right grips 72 and 73 can each have a thickness, width and length similar to the respective thickness, width and length discussed above with respect to bottom wall 32 and left and right side grip 33 and 34 of stamp assembly 21.

Bottom wall 71 is provided with a depending central portion 76 which steps down from the left and right sides 71*a* and 71*b* of the bottom wall. The central portion 76 has a first or top planar surface 77 and a second or bottom planar surface 78 which extend parallel to each other.

Optional cushion 46 is secured to bottom surface 78 of the central portion 76 and embossing member 28 is secured to cushion 46, in each case, in any of the manners discussed above with respect to stamp assembly 21. Central portion 76 has a size and shape in plan which approximates the size and shape of cushion 46. More specifically, the central portion 76, like bottom wall 32 of stamp mount 27 above, has a length and width which are slightly larger than the length and width of cushion 46.

In operation and use, stamp assembly 66 can be used in the same manner discussed above with respect stamp assembly 21. Depending central portion 76 serves to further inhibit ink from gathering on the bottom of left and right sides 71*a* and 71*b* of the bottom wall 71 and thus being undesirably transferred to surface 23 of the sheet of paper 26.

Figure 4:
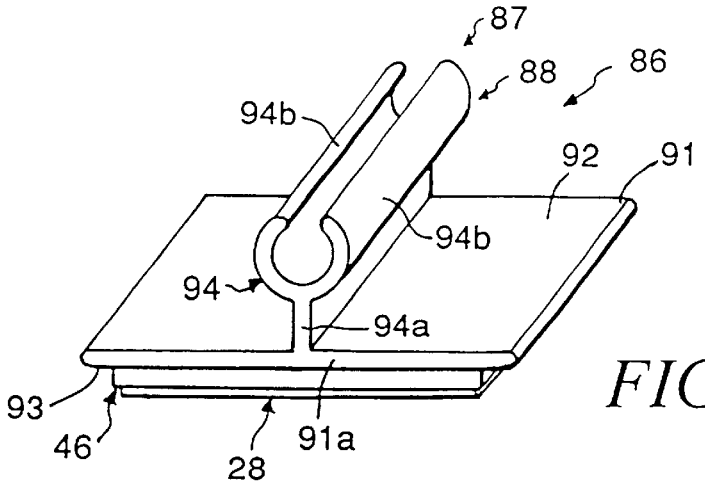
FIG. 4 is an isometric view of a further embodiment of the stamp assembly of the present invention.

Stamp assembly 86 shown in FIG. 4 has similarities to stamp assembly 21 and like reference numerals have been used to describe like components of stamp assemblies 21 and 86. A handle member or handle 87 is included in stamp assembly 86. The handle or stamp mount 87 is formed from a body 88 made from any of the suitable substantially rigid materials discussed above with respect to body 31 and is preferably made from an extruded plastic.

Body 88 has a substantially planar bottom wall 91 having a first or top surface 92 and an opposite second or bottom surface 93. At least one finger-grippable wall extends upwardly from the bottom wall 91. In this regard, the bottom wall has a center 91 a and a single wall or grip 94 is joined to the bottom wall at center 91*a* and, as shown, is formed integral with bottom wall 91. The grip 94 extends upwardly from the center 91*a* of the bottom wall so that stamp mount 87 resembles an inverted T. Although the grip 94 can be of any size or shape, it is shown as being substantially Y-shaped in cross section. More specifically, grip 94 has a lower portion or stem 94*a* extending perpendicularly from bottom wall 91 and first and second arcuately-shaped arms 94*b* extending upwardly and outwardly from stem 94*a*. The top ends of arms 94*b* approach but do not engage each other. As so formed, arms 94*b* provide grip 94 with an upper portion that resembles a slotted tube. Bottom wall 91 and stem 94*a* and arms 94*b* of grip 94 have a thickness and length similar to the respective thickness and length discussed above with respect to bottom wall 32 and left and right grips 33 and 34 of stamp assembly 21.

Optional cushion 46 is secured to bottom surface 93 of bottom wall 91 and embossing member 28 is secured to cushion 46, in each case, in any of the manners discussed above with respect to stamp assembly 21. Bottom wall 91 has a size and shape in plan which approximates the size and shape of cushion 46. More specifically, bottom wall 91 has a length and width which are slightly larger than the length and width of cushion 46.

In operation and use, stamp assembly 86 can be used in substantially the same manner as discussed above with respect to stamp assemblies 21 and 66. Grip 94 can be easily grasped by at least two fingers of the hand of the user. The Y-shaped conformation of grip 94 facilitates such gripping by providing an enlarged upper portion to the grip, that is first and second arms 94*b*, which can be easily gripped between the thumb and the opposing fingers of a human hand.

Figure 5:
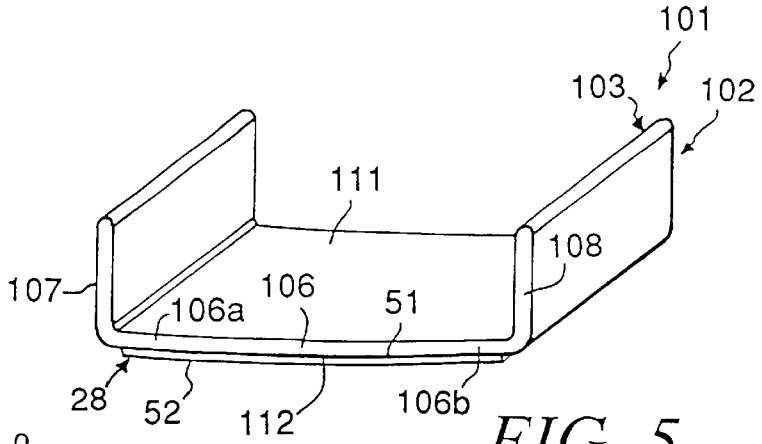
FIG. 5 is an isometric view of yet another embodiment of the stamp assembly of the present invention.

In a further embodiment, a stamp assembly 101 is disclosed in FIG. 5 that has similarities to stamp assembly 21. Like referenced numerals have been used to describe like components of stamp assemblies 21 and 101. A handle member or handle 102 is included in stamp assembly 101. The handle or stamp mount 102 is formed from a body 103 that has a U-shaped cross section and can be extruded from any suitable substantially rigid material such as plastic. Any of the materials discussed above with respect to stamp mount 27 of stamp assembly 21 are suitable for handle body 103.

A substantially planar bottom wall 106 having a first or left side 106*a* and a second or right side 106*b* is included within stamp mount 102. The bottom wall 106 is arcuate in conformation so as to be convex and thus bow downwardly at bottom surface 112. More specifically, the bottom wall 106 has a width between sides 106*a* and 106*b* ranging from 0.25 to eight inches and bows downwardly at its center a distance ranging from approximately 0.015 to 0.150 inch and preferably approximately 0.025 inch from an imaginary straight line drawn between the opposite sides 106*a* and 106*b* of the bottom wall 106. The amount of the bow in bottom wall 106 is dependent on the size of stamp mount 102. In this regard, the ratio of the bow in bottom wall 106 relative to the width of the wall 106 is typically greater for smaller sized stamp assemblies than for larger sized stamp assemblies.

At least one finger-grippable wall extends upwardly from the bottom wall 106. In this regard, a first or left side wall 107 extends outwardly from left side 106*a* at a substantially right angle and a second or right wall 108 extends upwardly from right side 106*b* at a substantially right angle. Planar walls 107 and 108, substantially identical to each other, are spaced apart from and parallel to each other. Bottom wall 106 and left and right side walls 107 and 108 each have a thickness and length similar to the respective thickness and length discussed above with respect to bottom wall 32 and left and right side walls 33 and 34 of stamp assembly 21.

Bottom wall 106 of stamp assembly 101 has a first or top substantially planar surface 111 and a second or bottom substantially planar, smooth surface 112 which extend parallel to each other. Embossing member 28 is secured to bottom surface 112 in any of the manners discussed above with respect to the means for securing cushion 46 to bottom surface 37 of stamp assembly 21. The bottom wall 106 has a size and shape in plan which approximates the size and shape of embossing member 28. More specifically, bottom wall 106 has a length and width which are slightly larger than the length and width of the embossing member 28.

In operation and use, stamp assembly 101 can be used in substantially the same manner as discussed above with respect to stamp assembly 21. In general embossing member 28 is mounted to bottom surface 112 of stamp mount 102 and ink is applied to the raised surface 56 of the embossing member. After raised surface 56 engages paper surface 23 and the application force is so provided by the user, the user thereafter rocks stamp mount 102 back and forth about an axis extending parallel to left and right side walls 107 and 108. Such rocking causes different segments of the raised surface 56 of embossing member 28 to sequentially engage paper surface 23 so that the whole of image 22 is formed on the paper 26.

Embossing member 28 is removably mounted to bottom surface 112. As a result, a plurality of embossing members (not shown) can alternatively be attached to the bottom surface 112 of bottom wall 106 for stamping different images on a surface of a worksheet, such as surface 23 of paper 26.

Stamp assembly 101 is simpler than stamp assembly 21 in that left and right side walls 107 and 108 are simpler in construction relative to left and right side walls 33 and 34 of stamp assembly 21. In addition, no cushion 46 is provided in stamp assembly 101. It should be appreciated, however, that a cushion 46 can be included stamp assembly 101 and be within the scope of the present invention.

The convex disposition of bottom wall 106 of handle body 103 results in a concentration of the stamping force on a small portion of embossing member 28. More specifically, such concentration of force occurs on a segment of the bottom wall 106 extending from the front to the rear of the bottom wall. The concentration produces a greater resultant force on paper surface 23 for a given application force relative to the same application force in a stamping assembly having a planar bottom wall, such as stamping assemblies 21, 66 and 86. In other words, a smaller application force is required by the user to provide an equal or even greater resultant force on the sequentially-engaged raised surface 56 of the embossing member 28. The sequential concentrations of force on embossing member 28 facilitate the formation of image 22. Stamp assembly 101 can more easily accommodate irregularities in paper surface 23 by being pressed into any recesses in surface 23 or contracting upwardly to accommodate any protuberances in the surface 23. In addition, the concentration of stamp forces permits greater precision in the formation of image 22 on work surface 23, particularly when stamp assembly 101 is transparent so that the formation of the image can be seen by the user through the material of the assembly 101.

Figure 6:
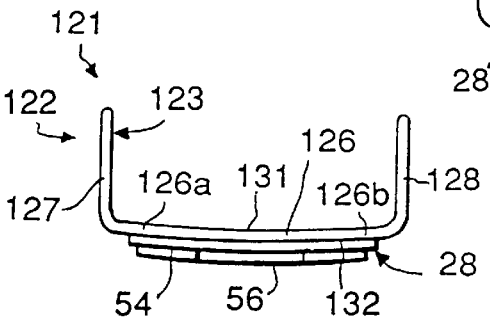
FIG. 6 is a front elevational view of yet a further embodiment of the stamp assembly of the present invention.

A further embodiment of the stamp assembly hereof is shown in FIG. 6. Stamp assembly 121 shown therein is substantially similar to stamp assemblies 21 and 101 and like reference numerals have been used to describe like components of stamp assemblies 21, 101 and 121. A handle member or handle 122 that is U-shaped in cross section is included in stamp assembly 121. Handle or stamp mount 122 is formed from a body 123 that can be extruded from any suitable substantially rigid material such as plastic. Any of the materials discussed above with respect to stamp mount 27 are suitable for handle body 123. A bottom wall 126 having a first or left side 126*a* and a second or right side 126*b* is included in body 123. A first or left side wall 127 extends upwardly from left side 126*a* and a second or right side wall 128 extends upwardly from right side 126*b*. Walls 127 and 128 are substantially identical to each other and are substantially similar to walls 107 and 108 of stamp assembly 101.

Bottom wall 126 and left and right sidewalls 127 and 128 are thin-walled members relative to the corresponding walls of stamp assembly 101. More specifically, bottom wall 126 and left and right side walls 127 and 128 each have a thickness ranging from 0.030 to 0.125 inch and preferably approximately 0.035 inch. The bottom wall 126 has a first or top surface 131 and a second or bottom surface 132 and is arcuate in conformation so as to be convex and thus bow outwardly at substantially smooth bottom surface 132. The bow in bottom wall 126 can be similar in dimensions to the bow discussed above in bottom wall 106 of stamp assembly 101. Embossing member 28 is secured to bottom surface 132 in any of the manners discussed above with respect to stamp assembly 21. A cushion 46 can optionally be included in stamp mount 122 of the stamp assembly 121.

In operation and use, the thinned bottom wall 126 and left and right side walls 127 and 128 of handle body 123 permit such walls to flex in the operation of stamp assembly 121. Thus a user can squeeze left and right side walls 127 and 128 towards each other so as to change the radius of curvature and thus the convex arc provided in bottom wall 126. The ability to vary the arc in bottom wall 126 can be valuable in the formation of image 22. Among other things, reducing the radius of bottom wall 126 results in a narrower segment of embossing member 28 engaging paper surface 23. As discussed above with respect to stamp assembly 101, the application force on stamp mount 122 can be concentrated on a portion or segment of the bottom wall 126. Stamp assembly 121 additionally permits the amount of application force exerted by the embossing member 28 on paper surface 23 to be varied in accordance with the deformation of handle body 123.

In an alternative embodiment of a thinned-walled, flexible stamp assembly (not shown), a stamp assembly similar to stamp assembly 121 can be provided in which bottom wall 126 is planar or even concave. The flexible bottom wall of such a stamp assembly can be deformed into an arcuate shape by the user, in a manner similar to that discussed above with respect to stamp assembly 121, to concentrate the application force on a portion or segment of the bottom wall for transfer thereby to the embossing member 28 secured thereto.

Figure 7:
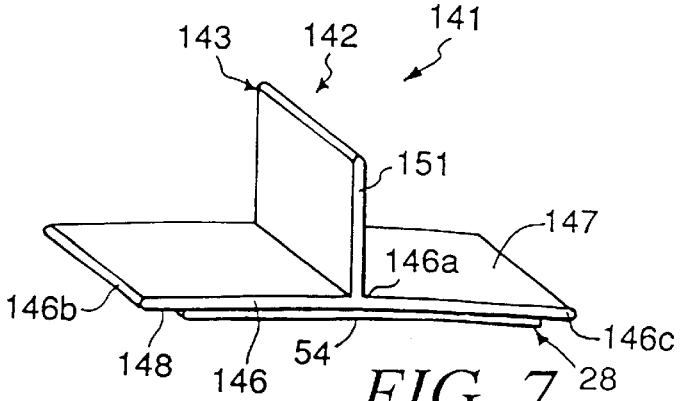
FIG. 7 is an isometric view of another embodiment of the stamp assembly of the present invention.

Stamp assemblies having support walls with concave or other conformations can also be provided. Stamp assembly 141 shown in FIG. 7 has a handle member or handle 142 formed from a substantially rigid body 143 having the shape of an inverted T. Body 143 can be extruded from any suitable material such as plastic and is preferably formed from any one of the materials discussed above with respect to stamp mount 27 of stamp assembly 21. Body 143 has a bottom wall 146 provided with a central portion 146*a*, a first or left side portion 146*b* and a second or right side portion 146*c*. The bottom wall 146 has a first or top surface 147 and a second or bottom substantially smooth surface 148. At least one finger-grippable wall extends upwardly from the bottom wall and, more specifically, a single central wall or grip 151 extends upwardly from top surface 147 of central portion 146*a* at a right angle to the wall 146. Bottom wall 146 and the generally planar central grip 151 can each have a thickness and length similar to the respective thickness and length discussed above with respect to bottom wall 32 and walls 33 and 34 of stamp assembly 21.

Bottom wall 146 is formed with an arc and, more specifically, is concave in conformation so as to bow inwardly at bottom surface 148. The bottom wall 146 can be formed with any suitable arc or bow. In the embodiment illustrated in FIG. 7, bottom wall 146 has a width ranging from 0.25 to eight inches between side portions 146*b* and 146*c* and bows upwardly at its center a distance ranging from 0.015 to 0.150 inch and preferably approximately 0.020 inch from an imaginary straight line drawn between the opposite side portions 146*b* and 146*c* of the bottom wall 146. In the same manner as discussed above with respect to stamp assembly 101, the amount of the bow in bottom wall 146 is dependent on the size of stamp handle or mount 142. Top surface 53 of embossing member 28 is secured to bottom surface 148 of body 143 in any of the manners discussed above with respect to stamp assembly 21. A cushion 46 can optionally be provided in stamp assembly 141.

Stamp assembly 141 is used in substantially the same manner as stamp assembly 101 described above. After embossing member 28 has been suitably secured to bottom wall 146, preferably by means of interfacial tack, ink is applied to raised surface 56 and the raised surface thereafter pressed against paper surface 23. The concave shape of bottom wall 146 results in the opposite outer side portions 146*b* and 146*c* of the bottom wall first coming in contact with paper surface 23. Further application of force to stamp assembly 141 results in bottom wall 146 moving to a flattened position so that substantially the entire raised surface 56 engages paper surface 23 to form image 22 thereon.

Stamp assembly 141 desirably utilizes a relatively thin bottom wall 146, which reduces the material requirements and thus the cost of the stamp assembly 141. The preformed concave shape in bottom wall 146 accommodates the flexibility of the wall 146. If a planar, flexible bottom wall was used in a stamp mount having a center grip, the application pressure applied by the bottom wall would be greatest at the center of the wall and decrease outwardly towards the opposite sides of the wall as a result of the flexibility in the wall Stamp assembly 141 compensates for the flexibility in wall 146 by increasing the application pressure at the sides of the wall so as to provide an approximately even application pressure profile across the bottom of the wall 146, similar to the application pressure profile one would expect if a rigid bottom wall 146 were utilized in stamp assembly 141.

Figure 8:
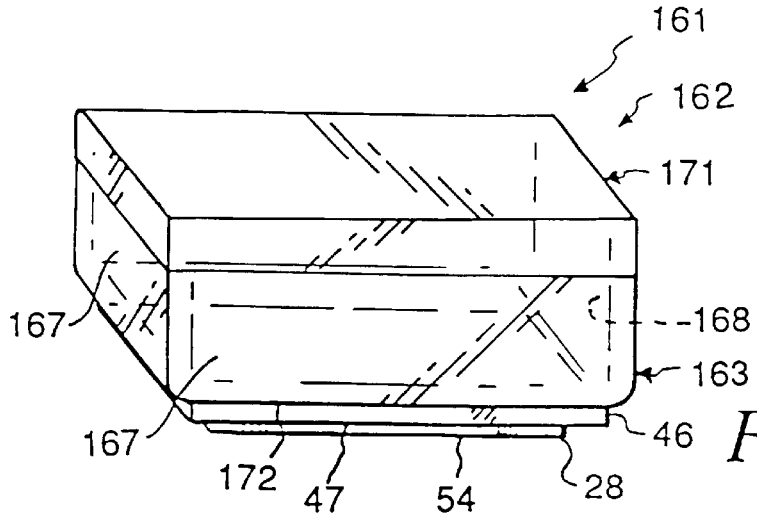
FIG. 8 is an isometric view of a further embodiment of the stamp assembly of the present invention in a closed condition.
Figure 9:
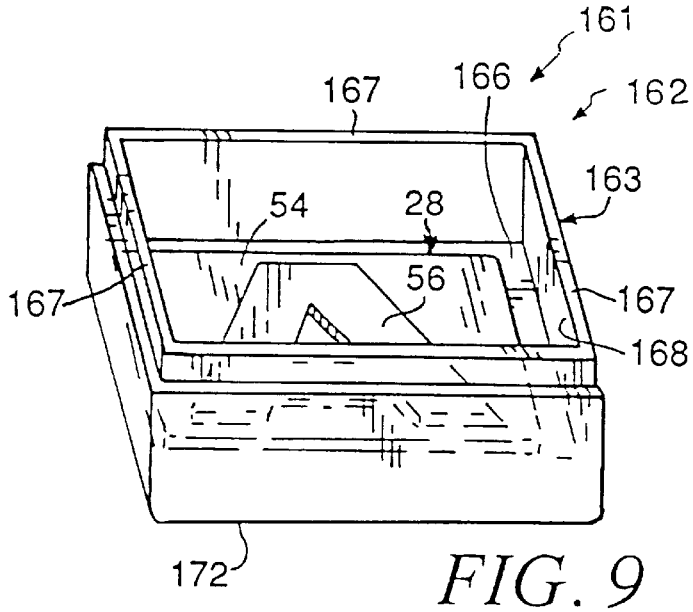
FIG. 9 is an isometric view of a portion of the stamp assembly of FIG. 8 in an open condition.

In another embodiment shown in FIGS. 8 and 9, a stamp assembly 161 is shown which comprises a handle member in the form of a hollow structure or container 162 for holding one or more embossing members 28. Enclosure or container 162 can be of any suitable shape, such as round, oval, elliptical, rectangular or square, In one preferred embodiment, container 162 is in the form of a box that is substantially in the shape of a parallelepiped. Container or box 162 includes a bottom portion 163 made from a bottom wall 166 and four side walls 167 extending at right angles to each other and to the bottom wall 166. Bottom portion 163 includes an interior cavity 168 formed by bottom wall 166 and side walls 167. Bottom wall 166 preferably has a length and width at least equal to the length and width of embossing member 28 and side walls 167 have a height at least equal to the thickness of embossing member 28 and preferably equal to a multiple of such thickness so that interior cavity 168 can hold at least one and preferably a plurality of embossing members 28. A cover portion or cover 171 is further included in box 162. The cover 171 cooperatively mates with bottom portion 163 so as to removably attach to bottom portion 163. Cover 171 can be completely removable from bottom portion 163, as shown, or hinged in any suitable manner to the bottom portion 163.

Bottom portion 166 is made from any suitable substantially rigid material such as any of the plastics discussed above with respect to handle body 31. Box cover 171 can also be made from any suitable plastic such as any of the plastics discussed above. Although bottom portion 166 and cover 171 can be made from an opaque material, they are preferably made from a material which is at least partially transparent and preferably sufficiently transparent so as to permit viewing of an image therethrough. Box bottom portion 163 and cover 171 can also be made from other substantially rigid materials such as metal, ceramic, glass or wood.

Bottom wall 166 has a substantially smooth bottom surface 172. Optional cushion 46 can be secured to bottom surface 172 in any of the manners discussed above with respect to stamp assembly 21. Top surface 53 of embossing member 28 is secured to the bottom surface 47 of cushion 46 in any of the manners discussed above. Alterative, embossing member 28 can be secured directly to bottom surface 172 of box bottom portion 163 in any of the manners discussed above. Cushion 46 and embossing member 28 are shown in FIG. 8 as being mounted to bottom surface 172. One embossing member 28 is shown being stored in box bottom portion 163 in FIG. 9.

In operation and use, at least one and preferably a plurality of embossing members 28 can be stored within internal cavity 168 of box 162 when not in use. When the box 162 is made from a transparent material, the embossing members 28 can easily be viewed within internal cavity 168 without removing cover 171. When a user desires to form an image from one of the embossing members, the embossing member 28 is removed from box 162 and removably attached to bottom surface 172 of the bottom wall 166 or to optional cushion 46 attached to the bottom surface 172. Thereafter, the user can grasp two of the opposite side walls 167 of box bottom portion 163 to press raised surface 56 against a suitable ink source and thereafter press the surface 56 against paper surface 23 to form image 22 thereon. If bottom portion 163 is empty during use or filled with only transparent embossing members 28, the transparent material of box bottom portion 163, as well as the transparent cushion 46 and embossing member 28, permit the user to view placement of image 22 on paper surface 23. Bottom wall 166 is generally planar and free of centrally disposed projections, such as central grips 94 and 151 described above, so as to facilitate viewing through the bottom wall 166. Cover 171 can be mounted to bottom portion 163 or removed during use of stamp assembly 161. The transparent material of cover 171 facilitates viewing through the cover when box 162 is closed with the cover 171 during use.

Figure 10:
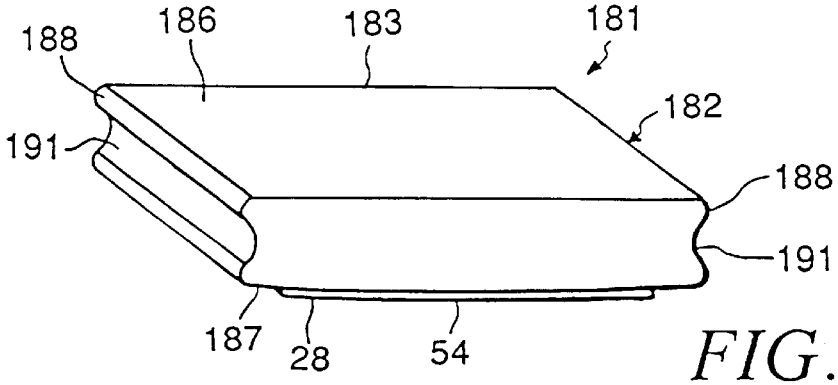
FIG. 10 is an isometric view of yet another embodiment of the stamp assembly of the present invention.

In a further embodiment shown in FIG. 10, a stamp assembly 181 comprising a handle member or handle 182 is shown. Handle or stamp mount 182 is made from a substantially rigid body 183 made from plastic or any other suitable material. Any of the materials discussed above with respect to handle body 31 are suitable for use in constructing handle body 183. The plate-like body 183 has a first or top planar surface 186 and an opposite second or bottom surface 187. In the illustrated embodiment, bottom surface 187 is planar, but it should be appreciated that the bottom surface 187 can be arcuate or convex like bottom surface 112 of stamp assembly 101. At least bottom surface 187 and preferably top surface 186 are substantially smooth. Opposite first or left and second or right sides 188 extend between top and bottom surfaces 186 and 187. Sides 188 are each provided with are recess 191 extending longitudinally there along for facilitating gripping of sides 188 by the fingers of a human hand. Body 183 is preferably made from a material which is at least partially transparent and preferably sufficiently transparent so as to permit viewing of an image through top and bottom surfaces 186 and 187. Embossing member 28 and optional cushion 46 are secured to bottom surface 187 by any of the means discussed above with respect to stamp assembly 21.

In operation and use, embossing member 28 is removably attached to body 183, either directly to bottom surface 187 or to cushion 46 which is attached to the bottom surface 187. When body 183 is made from a transparent material, viewing through the top and bottom surfaces 186 and 187 is facilitated during the pressing of raised surface 56 on paper surface 23 and the formation of image 22 thereon.

In another embodiment (not shown), stamp assembly 181 can be provided with a stamp mount that has a shape substantially similar to stamp mount 182 but provided with an internal cavity or chamber for storing one or more embossing members 128. For example, the stamp mount can be extruded so as to be tubular in shape, with the bore so formed therein serving as an internal chamber. A cap can optionally be provided for closing the chamber at each end for better retaining the embossing member(s) within the stamp mount. As discussed above, the stamp assemblies disclosed herein can be in the form of a hollow structure or enclosure for, among other things, storing one or more embossing members 28 therein. Any suitable extruded structure can be provided for forming an internal chamber or cavity.

Although the invention has been described as having only a single embossing member 28 secured to the stamp mount at a single time, it should be appreciated that a plurality of embossing members can be utilized for customizing the image to be created by the stamp assembly. For example, several figures, each on a separate embossing member, can be arranged on the bottom surface of the stamp mount to form the desired scene to be created on work surface 23. In another exemplary application, a plurality of individual letters can be assembled on the stamp mount to form a word.

In view of the foregoing, it can be seen that a new and improved stamp assembly having an embossing member that is removably secured to the stamp mount of the stamp assembly has been provided. The embossing member can be removably secured to the stamp mount by means of interfacial tack. The stamp assembly is preferably at least partially transparent so as to facilitate placement of the image on the surface of the workpiece. The surface of the stamp mount for receiving the embossing member can be arcuate in conformation and, more specifically, can be concave or convex. The stamp mount of the stamp assembly can be formed with a wall for receiving the embossing member that is bendable. The stamp mount of the stamp assembly can also be in the form of a container for storing the removable embossing member.

What is claimed is:

1. A stamp assembly for use with an ink to create an image having an area on a surface of a workpiece comprising a handle member having a surface with an area at least approximating the area of the image, a flexible sheet-like embossing member having opposite first and second sides, the first side having a first side surface and the second side having an embossed portion with a raised surface corresponding to the image, the first side of the embossing member being formed from an elastomer selected from the group consisting of thermoplastic elastomers, crosslinked elastomers and noncrosslinked rubbery materials, the elastomer being modified through the use of at least one plasticizer so as to be a modified elastomer with increased tack and flow properties and permitting the embossing member to be removably secured by means of interfacial tack to the surface of the handle member, the embossed portion being adapted to receive ink on the raised surface and the raised surface being adapted to thereafter engage the surface of the workpiece to form the image on the workpiece.

2. In a stamp assembly as in claim 1, the elastomer being selected from the group consisting of styrene butadiene rubber, styrene-ethylene-butylene-styrene rubber, polyisobutylene, silicone rubber, room temperature vulcanizing silicone and polyurethane elastomers.

3. In a stamp assembly as in claim 1, the surface of the handle member being substantially smooth and being formed from a material having a high surface energy and the first side surface of the embossing member being formed from a material having a low surface energy.

4. In a stamp assembly as in claim 3, the substantially smooth surface of the handle member being formed from a material having a surface energy greater than 30 dynes per centimeter.

5. In a stamp assembly as in claim 3, the first side surface of the embossing member being formed from a material having a surface energy less than 30 dynes per centimeter.

6. In a stamp assembly as in claim 1, the surface of the handle member being formed from a material that has the ability to be readily wetted by the first side surface of the embossing member.

7. In a stamp assembly as in claim 1, the modified elastomer be a gel selected from the group consisting of silicon, styrene-butadiene-styrene and styrene-ethylene-butylene-styrene polymers.

8. In a stamp assembly as in claim 1, each of the handle member and the embossing member being substantially transparent so as to permit viewing of the formation of the image on the workpiece.

9. In a stamp assembly as in claim 1, the handle member including a bottom wall and at least one finger-grippable wall extending upwardly from the bottom wall, the bottom wall and the at least one finger-grippable wall being formed of a substantially rigid material.

10. In a stamp assembly as in claim 9, the bottom wall having a center and the at least one finger-grippable wall extending upwardly from the center of the bottom wall so that the handle member resembles an inverted T.

11. In a stamp assembly as in claim 9, the bottom wall having first and second opposite sides, first and second finger-grippable walls extending upwardly from the respective first and second sides of the bottom wall so that the handle member is U-shaped.

12. In a stamp assembly as in claim 9, the bottom wall being bendable.

13. In a stamp assembly as in claim 9, the handle member being a container having a bottom portion provided with an interior cavity and having a removable top portion that cooperatively mates with the bottom portion to close the container, the interior cavity having a size and shape to store the embossing member when the embossing member is removed from the surface of the handle member.

14. In a stamp assembly as in claim 1, the surface of the handle member being concave.

15. In a stamp assembly as in claim 1, the surface of the handle member being convex.

16. In a stamp assembly as in claim 1, the handle member including a bottom wall, the bottom wall having a depending central portion being provided with the surface for receiving the embossing member, the depending central portion inhibiting the remainder of the handle member from contacting the workpiece during engagement of the raised surface with the workpiece.

17. In a stamp assembly as in claim 1, the handle member including a bottom wall and a sheet of an elastomeric material adhered to the bottom wall, the sheet of the elastomeric material having the surface for receiving the embossing member whereby the sheet of the elastomeric material facilitates formation of the image on the workpiece.

18. In a stamp assembly as in claim 17, the sheet of the elastomeric material being made from rubber.

19. In a stamp assembly as in claim 1, the first side of the embossing member being formed from an elastomer that is crosslinked by one of peroxide, irradiation, room temperature vulcanization or other similar techniques.

20. A stamp assembly for use with an ink to create an image having an area on a surface of a workpiece comprising a handle member having a bottom concave surface with an area at least approximating the area of the image, a layer of an elastomeric material, the elastomeric material permitting the layer to be removably secured by means of interfacial tack to the bottom surface of the handle member, a flexible sheet-like embossing member and means for securing the embossing member to the layer of an elastomeric material, the embossing member having a bottom provided with a raised surface corresponding to the image, the raised surface of the embossing member being adapted to receive ink and to thereafter engage the surface of the workpiece to form the image on the workpiece.

21. In a stamp assembly as in claim 20, the means for securing the embossing member including means for securing the embossing member to the layer of an elastomeric material by means of an adhesive.

22. In a stamp assembly as in claim 20, the means for securing the embossing member includes means for securing the embossing member to the layer of an elastomeric material by means of interfacial tack.

23. In a stamp assembly as in claim 20, each of the handle member, the layer of an elastomeric material and the embossing member being substantially transparent so as to permit viewing of the formation of the image on the workpiece.

24. A stamp assembly for use by a human hand with an ink to create an image having an area on a surface of a workpiece comprising a unitary handle member having a bottom wall and opposite first and second side portions and first and second spaced-apart side walls extending upwardly from the respective first and second side portions so that the handle member is substantially U-shaped in conformation, the bottom wall having a bottom surface with an area at least approximating the area of the image, a flexible sheet-like embossing member and means for adhering the embossing member to the bottom surface of the bottom wall, the embossing member having a raised surface corresponding to the image and being adapted to receive ink on the raised surface so that the raised surface can engage the surface of the workpiece to form the image on the workpiece whereby the first and second spaced-apart side walls can be gripped by two fingers of the human hand for forming the image on the surface of the workpiece.

25. In a stamp assembly as in claim 24, the bottom wall and the embossing member each being substantially transparent so as to permit viewing of the formation of the image on the workpiece through the bottom wall.

26. In a stamp assembly as in claim 24, the means for adhering the embossing member including means for adhering the embossing member to the bottom surface of the bottom wall by means of interfacial tack.

27. In a stamp assembly as in claim 24, the bottom wall including a sheet of an elastomeric material having the bottom surface, the embossing member being adhered to the bottom surface of the sheet of an elastomeric material.

28. In a stamp assembly as in claim 24, the bottom wall being bendable.

29. A stamp assembly for use with an ink to create an image having an area on a surface of a workpiece comprising a unitary container provided with an interior cavity communicating with an opening in the container and having a bottom surface with an area at least approximating the area of the image, a flexible sheet-like embossing member removably adherable to the bottom surface, the interior cavity having a size and shape to fully receive the embossing member so that when the embossing member is removed from the bottom surface the embossing member can be stored in the interior cavity, a cover engageable with the container at the opening to enclose the embossing member within the interior cavity during storage and transport, the embossing member having a raised surface corresponding to the image, the embossing member being adapted to receive ink on the raised surface and to thereafter engage the surface of the workpiece to form the image on the workpiece.

30. In a stamp assembly as in claim 29, each of the container, the cover and the embossing member being substantially parent so as to permit viewing of the formation of the image on the workpiece.

31. In a stamp assembly as in claim 29, the container including a bottom portion and a sheet of an elastomeric material adhered to the bottom portion, the sheet of the elastomeric material having the surface for receiving the embossing member whereby the sheet of the elastomeric material facilitates formation of the image on the workpiece.

32. In a stamp assembly as in claim 29, the cover being detachable from the container.

33. An apparatus for use with a handle member having a surface and with an ink to create an image on a surface of a workpiece comprising a flexible sheet-like embossing member having opposite first and second sides, the first side being adapted to engage the surface of the handle member and the second side having an embossed portion with a raised surface corresponding to the image, the first side of the embossing member being formed from an elastomer selected from the group consisting of thermoplastic elastomers, crosslinked elastomers and noncrosslinked rubbery materials, the elastomer being modified through the use of at least one plasticizer so as to be a modified elastomer with increased tack and flow properties and permitting the embossing member to be removably secured by means of interfacial tack to the surface of the handle member whereby upon securing of the embossing member to the handle member the embossed portion can receive ink on the raised surface and the raised surface can thereafter engage the surface of the workpiece to form the image on the workpiece.

34. In an apparatus as in claim 33, the elastomer being selected from the group consisting of styrene butadiene rubber, styrene-ethylene-butylene-styrene rubber, polyisobutylene, silicone rubber, room temperature vulcanizing silicone and polyurethane elastomers.

35. In an apparatus as in claim 33, the modified elastomer being a gel selected from the group consisting of silicone, styrene-butadiene-styrene and styrene-ethylene-butylene-styrene polymers.

36. In an apparatus as in claim 33, the first side of the embossing member being formed from an elastomer that is crosslinked by one of peroxide, irradiation, room temperature vulcanization or other similar techniques.

* * * * *